US009060619B2

(12) United States Patent
Heimbrock et al.

(10) Patent No.: US 9,060,619 B2
(45) Date of Patent: Jun. 23, 2015

(54) VARIABLE HEIGHT SIDERAIL

(71) Applicant: Hill-Rom Services, Inc., Batesville, IN (US)

(72) Inventors: Richard H. Heimbrock, Cincinnati, OH (US); Brian T. Wiggins, Burlington, KY (US)

(73) Assignee: Hill-Rom Services, Inc., Batesville, IN (US)

( * ) Notice: Subject to any disclaimer, the term of this patent is extended or adjusted under 35 U.S.C. 154(b) by 0 days.

(21) Appl. No.: 14/176,188

(22) Filed: Feb. 10, 2014

(65) Prior Publication Data

US 2014/0150180 A1 Jun. 5, 2014

Related U.S. Application Data

(63) Continuation of application No. 13/733,980, filed on Jan. 4, 2013, now Pat. No. 8,646,131, which is a continuation of application No. PCT/US2011/043392, filed on Jul. 8, 2011.

(60) Provisional application No. 61/369,152, filed on Jul. 30, 2010, provisional application No. 61/369,499, filed on Jul. 30, 2010.

(51) Int. Cl.
*A47C 21/08* (2006.01)
*A61G 7/05* (2006.01)

(52) U.S. Cl.
CPC ..... *A47C 21/08* (2013.01); *A61G 7/0507* (2013.01); *A61G 2007/0509* (2013.01); *A61G 2007/0514* (2013.01)

(58) Field of Classification Search
CPC ..... A47C 21/08
USPC ..... 5/424–430, 100, 662
See application file for complete search history.

(56) References Cited

U.S. PATENT DOCUMENTS 421,656 A 2/1890 Blanken
993,119 A 5/1911 Stannard
(Continued)

FOREIGN PATENT DOCUMENTS

DE 199 00 602 C1 7/2000
EP 0 037 063 A2 10/1981
(Continued)

OTHER PUBLICATIONS

Paramount Bed Product Brochure, date unknown (63 pages).
(Continued)

*Primary Examiner* — Fredrick Conley
(74) *Attorney, Agent, or Firm* — Barnes & Thornburg LLP

(57) ABSTRACT

A siderail comprises a rail having a lower edge extending longitudinally from a head end to a foot end, and a longitudinally outer link comprising a head side outer link segment and a foot side outer link segment. Each segment is connected to the rail at a joint OR and connected to a host frame at a joint OF. The siderail also includes an inner link longitudinally intermediate the outer link segments and connected to the rail at a joint IR and to the host frame at a joint IF. The head side outer link segment extends longitudinally from approximately the head end of the rail lower edge toward the inner link without longitudinally overlapping the inner link. The foot side outer link segment extends longitudinally from approximately the foot end of the rail lower edge toward the inner link without longitudinally overlapping the inner link.

16 Claims, 14 Drawing Sheets

(56) References Cited

U.S. PATENT DOCUMENTS 1,398,203 A 11/1921 Schmidt
2,136,088 A 11/1938 Stevens
2,164,484 A 7/1939 Wolfe
2,281,209 A 4/1942 Smith
2,452,366 A 10/1948 Freund
2,556,591 A 6/1951 Loxley
2,564,083 A 8/1951 Stechert
2,587,291 A 2/1952 Rochers
2,605,151 A 7/1952 Shampaine
2,644,173 A 7/1953 James
2,710,976 A 6/1955 Martensen
2,722,017 A 11/1955 Burst et al.
2,766,463 A 10/1956 Bendersky
2,817,854 A 12/1957 Pratt
2,817,855 A 12/1957 Pratt
2,869,614 A 1/1959 Wamsley
2,951,252 A 9/1960 Roche
3,010,121 A 11/1961 Breach
3,018,492 A 1/1962 Rosen
3,021,534 A 2/1962 Hausted
3,053,568 A 9/1962 Miller
3,055,020 A 9/1962 Mann
3,099,440 A 7/1963 Burzlaff
3,112,500 A 12/1963 MacDonald
3,138,805 A 6/1964 Piazza
3,148,387 A 9/1964 Sarnie et al.
3,210,779 A 10/1965 Herbold
3,220,021 A 11/1965 Nelson
3,220,022 A 11/1965 Nelson
3,233,255 A 2/1966 Propst
3,239,853 A 3/1966 MacDonald
3,249,387 A 5/1966 Pivacek
3,256,533 A 6/1966 Michelsen
3,309,717 A 3/1967 Black
3,321,779 A 5/1967 Kaufman et al.
3,344,445 A 10/1967 Crawford
3,351,962 A 11/1967 Dodrill et al.
3,406,772 A 10/1968 Ahrent et al.
3,456,269 A 7/1969 Goodman
3,486,176 A 12/1969 Murcott
3,585,659 A 6/1971 Burst et al.
3,593,350 A 7/1971 Knight et al.
3,619,824 A 11/1971 Doyle
3,640,556 A 2/1972 Hodge
3,742,530 A 7/1973 Clark
3,845,511 A 11/1974 Benoit et al.
3,851,345 A 12/1974 Benoit et al.
3,865,434 A 2/1975 Sully
3,877,090 A 4/1975 Schultz
3,893,197 A 7/1975 Ricke
3,897,973 A 8/1975 Long et al.
3,905,591 A 9/1975 Schorr et al.
3,916,461 A 11/1975 Kerstholt
3,971,083 A 7/1976 Peterson
4,127,906 A 12/1978 Zur
4,139,917 A 2/1979 Fenwick
4,168,099 A 9/1979 Jacobs et al.
4,183,015 A 1/1980 Drew et al.
4,186,456 A 2/1980 Huempfner
4,214,326 A 7/1980 Spann
4,215,446 A 8/1980 Mahoney
4,232,415 A 11/1980 Webber
4,240,169 A 12/1980 Roos
4,258,445 A 3/1981 Zur
4,312,500 A 1/1982 Janssen
4,336,621 A 6/1982 Schwartz et al.
4,370,765 A 2/1983 Webber
4,409,695 A 10/1983 Johnston et al.
4,439,880 A 4/1984 Koncelik et al.
4,453,732 A 6/1984 Assanah et al.
D276,112 S 10/1984 Ferrell et al.
4,557,471 A 12/1985 Pazzini
4,607,402 A 8/1986 Pollard
4,612,679 A 9/1986 Mitchell
4,653,129 A 3/1987 Kuck et al.
4,654,903 A 4/1987 Chubb et al.
4,670,923 A 6/1987 Gabriel et al.
4,672,698 A 6/1987 Sands
4,675,926 A 6/1987 Limdblom et al.
4,676,687 A 6/1987 Koffler
4,685,159 A 8/1987 Oetiker
4,704,750 A 11/1987 Wheelock
4,710,049 A 12/1987 Chang
4,710,992 A 12/1987 Falwell
4,745,647 A 5/1988 Goodwin
4,747,171 A 5/1988 Einsele et al.
4,751,754 A 6/1988 Bailey et al.
4,767,419 A 8/1988 Fattore
4,768,249 A 9/1988 Goodwin
4,783,864 A 11/1988 Turner
4,800,600 A 1/1989 Baum
4,827,545 A 5/1989 Arp
4,839,933 A 6/1989 Plewright et al.
4,847,929 A 7/1989 Pupovic
4,858,260 A 8/1989 Failor et al.
4,862,529 A 9/1989 Peck
4,862,530 A 9/1989 Chen
4,872,228 A 10/1989 Bishop
4,873,734 A 10/1989 Pollard
4,894,876 A 1/1990 Fenwick
4,944,055 A 7/1990 Shainfeld
4,974,905 A 12/1990 Davis
4,985,946 A 1/1991 Foster et al.
4,993,089 A 2/1991 Solomon et al.
5,010,611 A 4/1991 Mallett
5,035,014 A 7/1991 Blanchard
5,040,253 A 8/1991 Cheng
5,060,327 A 10/1991 Celestina et al.
5,072,463 A 12/1991 Willis
5,077,843 A 1/1992 Foster et al.
5,083,332 A 1/1992 Foster et al.
5,083,334 A 1/1992 Huck et al.
5,084,925 A 2/1992 Cook
5,097,550 A 3/1992 Marra
5,129,117 A * 7/1992 Celestina et al. ..... 5/602
5,175,897 A 1/1993 Marra
5,179,744 A 1/1993 Foster et al.
5,191,663 A 3/1993 Holder et al.
5,193,633 A 3/1993 Ezenwa
5,197,156 A 3/1993 Stryker et al.
5,205,004 A 4/1993 Hayes et al.
D336,577 S 6/1993 Celestina et al.
5,216,768 A 6/1993 Bodine et al.
5,230,113 A 7/1993 Foster et al.
5,279,010 A 1/1994 Ferrand et al.
5,365,623 A 11/1994 Springer
5,381,571 A 1/1995 Gabhart
5,384,927 A 1/1995 Mardero et al.
5,410,765 A 5/1995 Youngblood
5,418,988 A 5/1995 Iura
5,421,046 A 6/1995 Vande Streek
5,450,641 A 9/1995 Montgomery
5,454,126 A 10/1995 Foster et al.
5,455,973 A 10/1995 Brumfield et al.
5,479,666 A 1/1996 Foster et al.
5,481,772 A 1/1996 Glynn et al.
5,485,699 A 1/1996 Gabhart
5,524,306 A 6/1996 George
5,537,701 A 7/1996 Elliott
5,542,135 A 8/1996 Ozrovitz et al.
5,557,817 A 9/1996 Haddock
5,575,025 A 11/1996 Peters
5,577,277 A 11/1996 Sundberg et al.
5,577,279 A 11/1996 Foster et al.
5,642,545 A 7/1997 Howard
5,671,490 A 9/1997 Wu
5,678,267 A 10/1997 Kinder
5,689,839 A 11/1997 Laganiere et al.
5,715,548 A 2/1998 Weismiller et al.
5,732,423 A 3/1998 Weismiller et al.
5,745,937 A 5/1998 Weismiller et al.
5,749,112 A 5/1998 Metzler
5,761,756 A 6/1998 Nowak et al.
5,771,506 A 6/1998 Joiner

(56) References Cited

U.S. PATENT DOCUMENTS

| | | | | |
|---|---|---|---|---|
| 5,781,945 | A | 7/1998 | Scherer et al. | |
| 5,802,636 | A | 9/1998 | Corbin et al. | |
| 5,832,549 | A | 11/1998 | Le Pallec et al. | |
| 5,864,900 | A | 2/1999 | Landau | |
| 5,878,452 | A | 3/1999 | Brooke et al. | |
| 5,926,873 | A | 7/1999 | Fountain | |
| 5,987,666 | A | 11/1999 | Zigmont | |
| 6,038,721 | A | 3/2000 | Gordon | |
| 6,058,531 | A | 5/2000 | Carroll | |
| 6,089,593 | A | 7/2000 | Hanson et al. | |
| 6,347,422 | B2 | 2/2002 | Heavrin | |
| 6,374,440 | B1 | 4/2002 | Thim, Jr. | |
| 6,397,416 | B2 | 6/2002 | Brooke et al. | |
| 6,401,277 | B1 | 6/2002 | Savage et al. | |
| 6,401,281 | B1 | 6/2002 | Younge | |
| 6,427,264 | B1 | 8/2002 | Metz et al. | |
| 6,430,766 | B1 | 8/2002 | Henley et al. | |
| 6,725,476 | B2 | 4/2004 | Macari | |
| 6,938,289 | B2 | 9/2005 | Morin | |
| 6,959,463 | B2 | 11/2005 | Macari | |
| 7,028,352 | B2 | 4/2006 | Kramer et al. | |
| 7,055,193 | B2 | 6/2006 | Macari et al. | |
| 7,073,220 | B2 | 7/2006 | Simmonds et al. | |
| 7,080,419 | B2 | 7/2006 | Macari | |
| 7,150,053 | B2 | 12/2006 | Macari | |
| 7,350,248 | B2 | 4/2008 | Hensley et al. | |
| 7,467,427 | B1 | 12/2008 | Wu et al. | |
| 7,676,862 | B2 | 3/2010 | Poulos et al. | |
| 7,712,167 | B2 | 5/2010 | Guguin et al. | |
| 7,814,588 | B2 | 10/2010 | Guguin et al. | |
| 7,930,778 | B2 | 4/2011 | Wu et al. | |
| 8,646,131 | B2 | 2/2014 | Heimbrock et al. | |
| 2002/0144348 | A1 | 10/2002 | Ganance | |
| 2003/0093860 | A1 | 5/2003 | Kramer et al. | |
| 2004/0049849 | A1 | 3/2004 | Macari | |
| 2004/0154100 | A1 | 8/2004 | Macari | |
| 2004/0177443 | A1* | 9/2004 | Simmonds et al. | 5/428 |
| 2005/0160527 | A1 | 7/2005 | Morin | |
| 2005/0198734 | A1 | 9/2005 | Macari | |
| 2005/0235419 | A1 | 10/2005 | Macari | |
| 2005/0246837 | A1 | 11/2005 | Macari et al. | |
| 2006/0090260 | A1 | 5/2006 | Stryker et al. | |
| 2006/0130233 | A1 | 6/2006 | Macari et al. | |
| 2008/0201844 | A1 | 8/2008 | Gemeline et al. | |
| 2009/0144898 | A1 | 6/2009 | Wu et al. | |
| 2011/0219541 | A1* | 9/2011 | Jacobs et al. | 5/430 |
| 2012/0023666 | A1 | 2/2012 | Heimbrock et al. | |
| 2012/0023667 | A1 | 2/2012 | Wiggins et al. | |
| 2012/0102643 | A1 | 5/2012 | Turner et al. | |
| 2012/0144583 | A1 | 6/2012 | Turner | |
| 2013/0117934 | A1 | 5/2013 | Heimbrock et al. | |

FOREIGN PATENT DOCUMENTS

| | | |
|---|---|---|
| EP | 2210529 | 7/2010 |
| FR | 1450817 | 8/1966 |
| GB | 1466080 | 4/1977 |
| GB | 2313303 | 11/1997 |
| WO | WO 98/17153 | 4/1998 |
| WO | WO 99/15126 | 4/1999 |

OTHER PUBLICATIONS

Hill-Rom Med Surg Bed Accessories, 1997, (6 pages).
User Manual AvantGuard® 1600/L1160Ax Electric Bed, 149214 Rev. 006, Mar. 2010.
User Manual Affinity® Three Birthing Bed and Affinity® Four Birthing Bed From Hill-Rom Product No. P3700 USR025 Rev 4. Dec. 2009.
Service Manual AvantGuard® 1600 Electric bed LI160Ax 149223 Rev. 002. Second edition, Apr. 2010 first printing, Mar. 2008.
Services Manual AvantGuard® 1600 Electric bed with weigh system L1160A2. 155725 Rev. 003. Third edition, Apr. 2010, first printing 2009.
Service Manual Hill-Rom® Basic Care™ Bed, Hill-Rom® 305 Manual Bed, Hill-Rom® 405 Electric Bed From Hill-Rom Product No. P1440/P1441 MAN336 Rev 2. Second Edition Mar. 2008 First Printing May 2004 printed in the USA.
User Manual Hill-Rom ® Basic Care™ Bed, Hill-Rom® 405 Electric Bed From Hill-Rom Product No. P1440/P1441 USR124 Rev 7. Seventh Edition Dec. 2007, first Printing Mar. 2004.
Affinity Siderails Photographs dated Dec. 2009, numbered 1-6.
Information Disclosure Statement by Applicant dated Jan. 24, 2013.
Non-Final Office Action for U.S. Appl. No. 13/023,133, dated Feb. 1, 2013.
PTO-892 from U.S. Appl. No. 13/023,133.
Response to Office Action dated Feb. 1, 2013, filed on Jun. 28, 2013.
Final Office Action for U.S. Appl. No. 13/0233,133, dated Jul. 30, 2013.
Response to Office Action dated Jul. 30, 2013, filed on Dec. 2, 2013.
Notice of Appeal From the Examiner to the Patent Trial and Appeal Board, Dated Dec. 2, 2013.

* cited by examiner

VARIABLE HEIGHT SIDERAIL

CROSS-REFERENCE TO RELATED APPLICATIONS

This application is a continuation of U.S. application Ser. No. 13/733,980, filed Jan. 4, 2013, issued as U.S. Pat. No. 8,646,131, which is a continuation of PCT International Application No. PCT/US2011/043392 which was filed Jul. 8, 2011, which is hereby expressly incorporated by reference herein, and which claimed the benefit of U.S Provisional Patent Application No. 61/369,152 filed Jul. 30, 2010 and U.S. Provisional Patent Application No. 61/369,499 filed Jul. 30, 2010, each of which is hereby expressly incorporated by reference herein. PCT International Application No. PCT/US2011/043392 also claimed priority to U.S. application Ser. No. 12/847,337 filed Jul. 30, 2010; U.S application Ser. No. 12/833,321 filed Jul. 9, 2010; and U.S. application Ser No. 12/836,606 filed Jul. 15, 2010; but the present application does not claim priority to any of those three U.S. utility patent applications.

BACKGROUND

The subject matter described herein relates to siderails of the type used on hospital beds and particularly to a siderail having a variable height that enables the siderail to comply with potentially conflicting design requirements.

Beds of the type used in hospitals, other health care facilities and home health care settings include a frame, a deck, a mattress resting on the deck and a set of siderails. The siderails have a deployed or raised position and a lowered or stored position. In the deployed position the top of the siderail should be a minimum distance above the top of the deck, and the bottom of the siderail should be low enough, and close enough to the neighboring lateral side of the deck, to ensure that any gap between the siderail and the deck is less than a specified amount, for example 60 mm. In the stowed position, the top of the siderail should be a minimum distance below the top of the mattress to facilitate occupant ingress and egress, and the distance from the bottom of the siderail to the floor should be no less than a prescribed amount, for example 120 mm. A siderail tall enough to satisfy the requirements of the deployed state may be too tall to satisfy one or both of the requirements of the stored state. Conversely, a siderail short enough to satisfy the requirements of the stored state may be too short to satisfy one or both of the requirements of the deployed state.

Siderails should also be designed to minimize "pinch points", i.e. spaces large enough to receive a foreign object when the siderail is in one position, but which become small enough to trap the object when the siderail is placed in a different position.

SUMMARY

A siderail comprises a rail having a lower edge extending longitudinally from a head end to a foot end, and a longitudinally outer link comprising a head side outer link segment and a foot side outer link segment. Each segment is connected to the rail at a joint OR and connected to a host frame at a joint OF. The siderial also includes an inner link longitudinally intermediate the outer link segments and connected to the rail at a joint IR and to the host frame at a joint IF. The head side outer link segment extends longitudinally from approximately the head end of the rail lower edge toward the inner link without longitudinally overlapping the inner link. The foot side outer link segment extends longitudinally from approximately the foot end of the rail lower edge toward the inner link without longitudinally overlapping the inner link.

BRIEF DESCRIPTION OF THE DRAWINGS

The foregoing and other features of the various embodiments of the siderail described herein will become more apparent from the following detailed description and the accompanying drawings in which.

DETAILED DESCRIPTION

Figure 1:
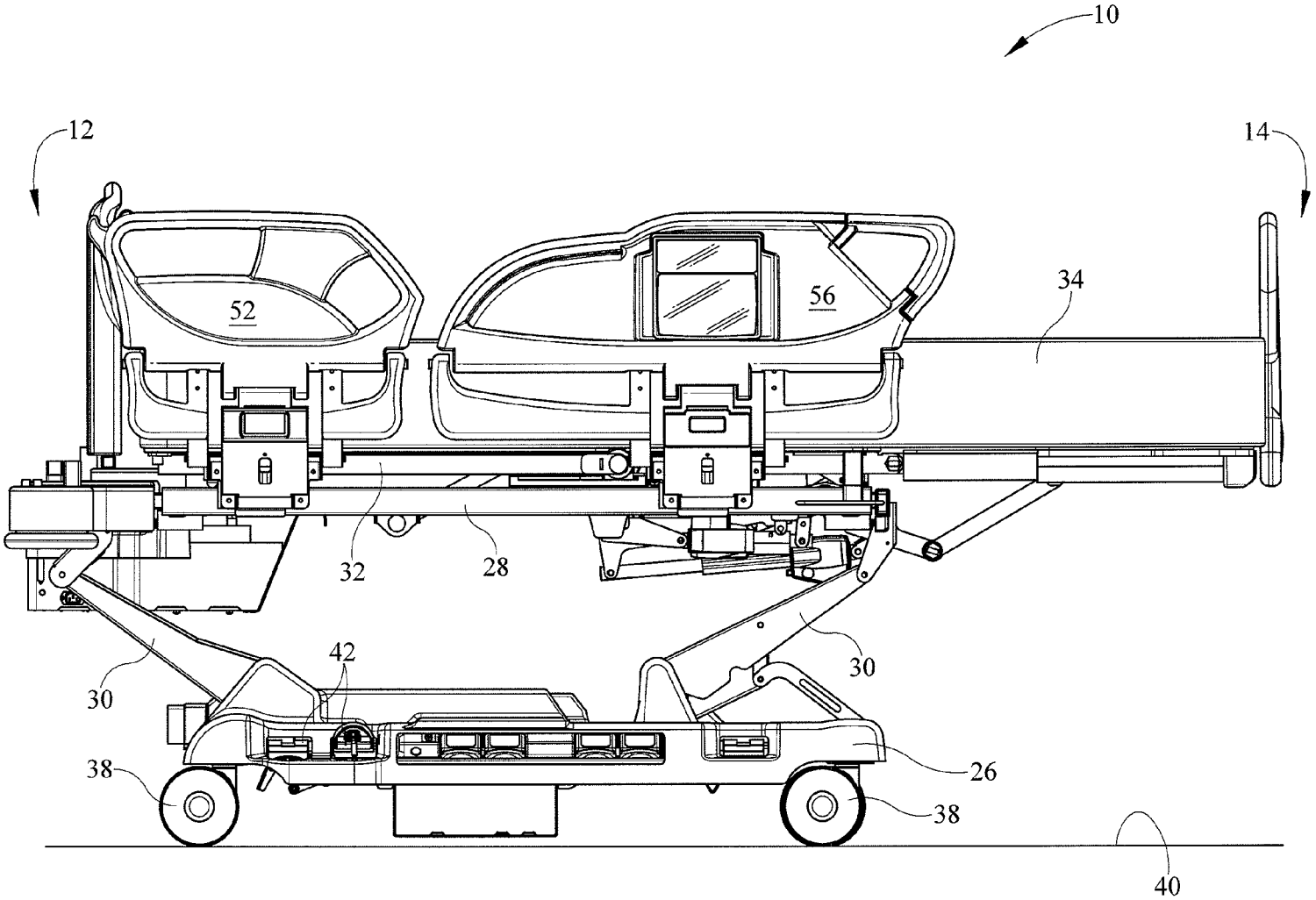
FIG. 1 is a right side elevation view of a hospital bed having variable height siderails as described herein.
Figure 2:
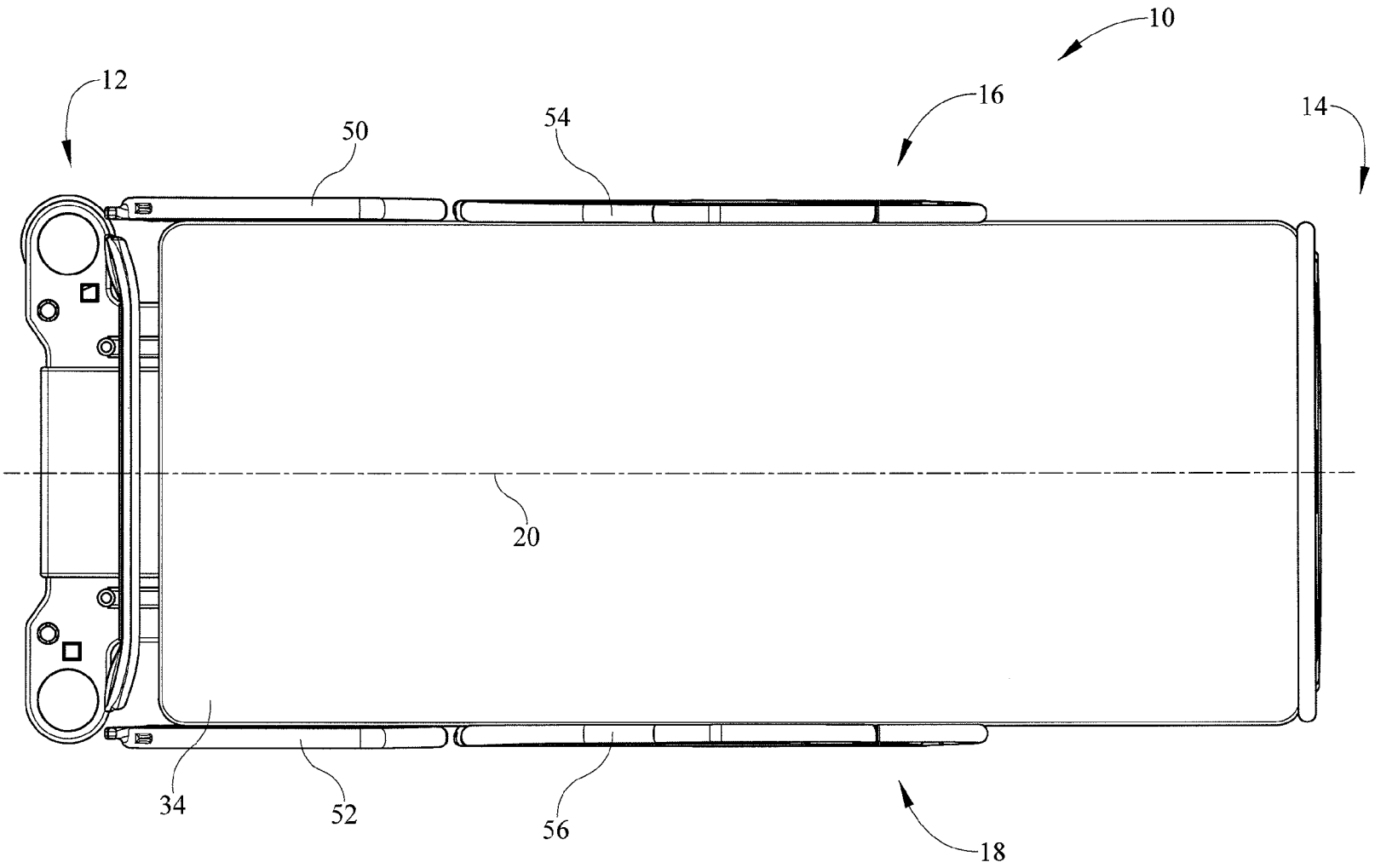
FIG. 2 is a plan view of the bed of FIG. 1.

Referring to FIGS. 1-2, a hospital bed 10 having a longitudinally extending centerline 20 extends longitudinally from a head end 12 to a foot end 14 and laterally from a left side 16 to a right side 18. The bed includes a base frame 26 and an elevatable frame 28 mounted on the base frame by interframe links 30. The elevatable frame includes a deck 32. A mattress 34 rests on the deck. Casters 38 extend from the base frame to the floor 40.

The bed also includes left and right head end siderails 50, 52 and left and right foot end siderails 54, 56. The head end siderails are substantially mirror images of each other. Similarly, the foot end siderails are substantially mirror images of each other. Each head end siderail differs from its neighboring foot end siderail, however the differences do not extend to the variable height attribute described herein. Accordingly it will suffice to describe only one siderail in detail.

Figure 3:
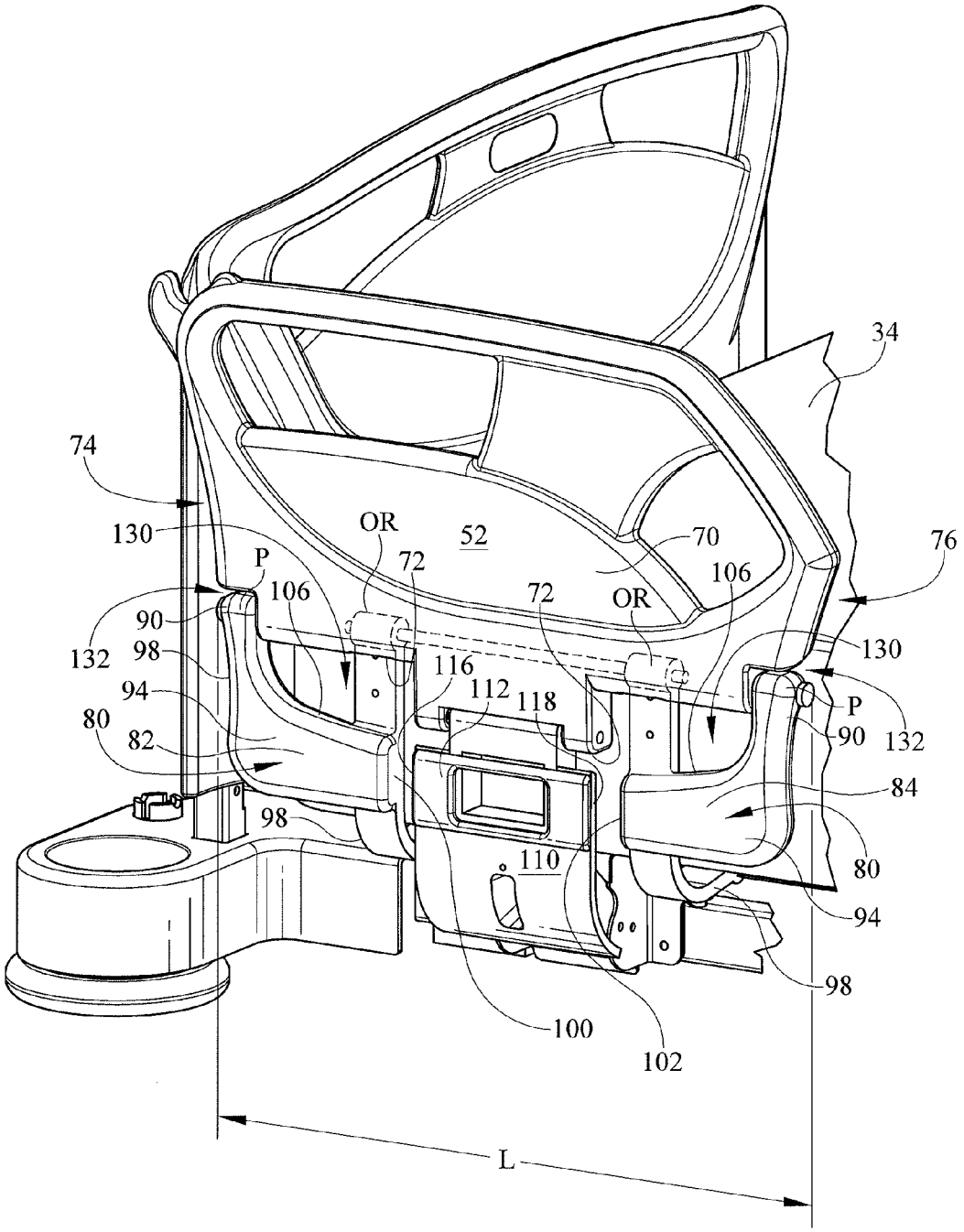
FIG. 3 is a perspective view of the right side, head end siderail of FIG. 1 in a raised or deployed state as seen from the non-occupant side of the siderail.
Figure 4:
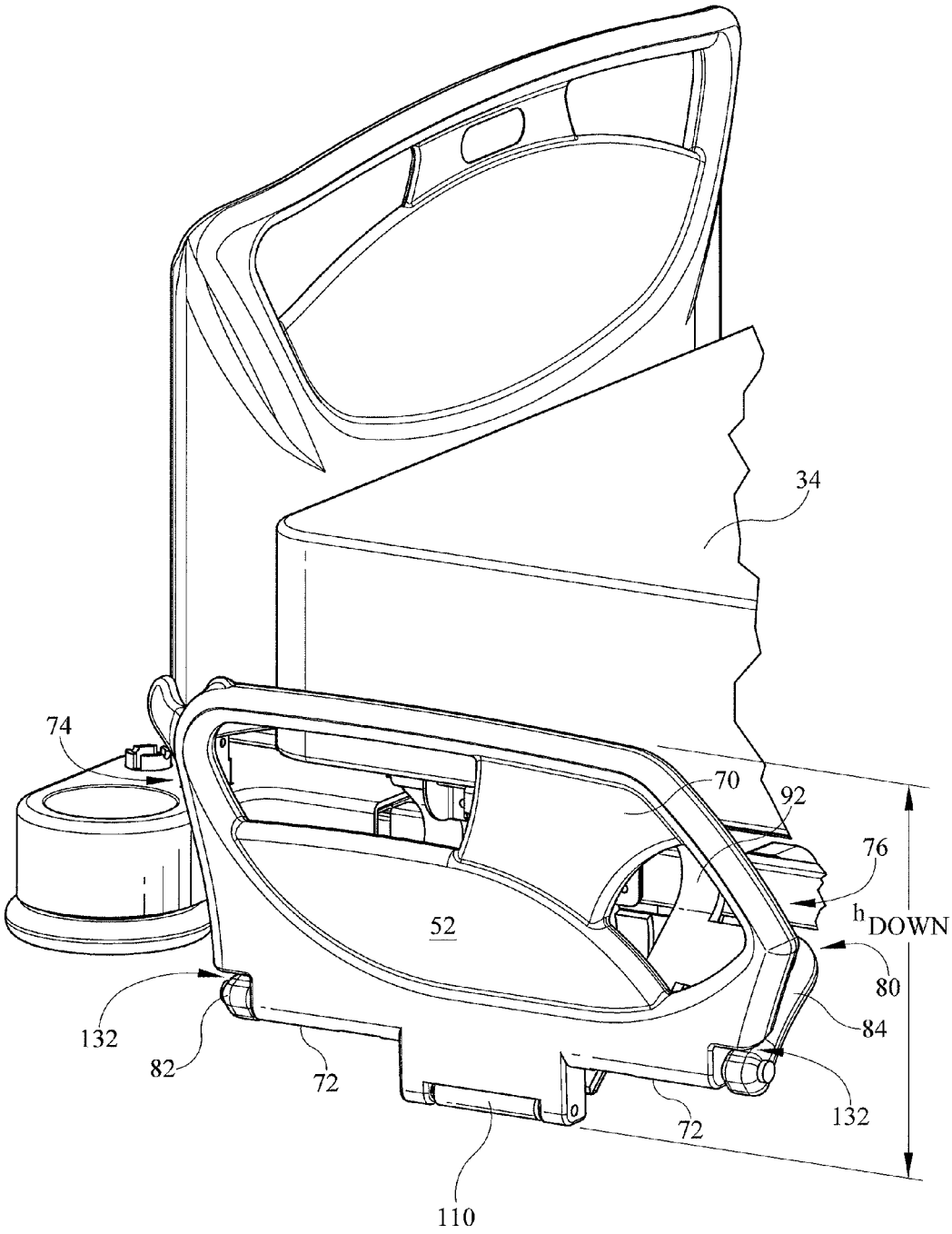
FIG. 4 is a view similar to that of FIG. 3 with the siderail in a lowered or stored state.
Figure 5:
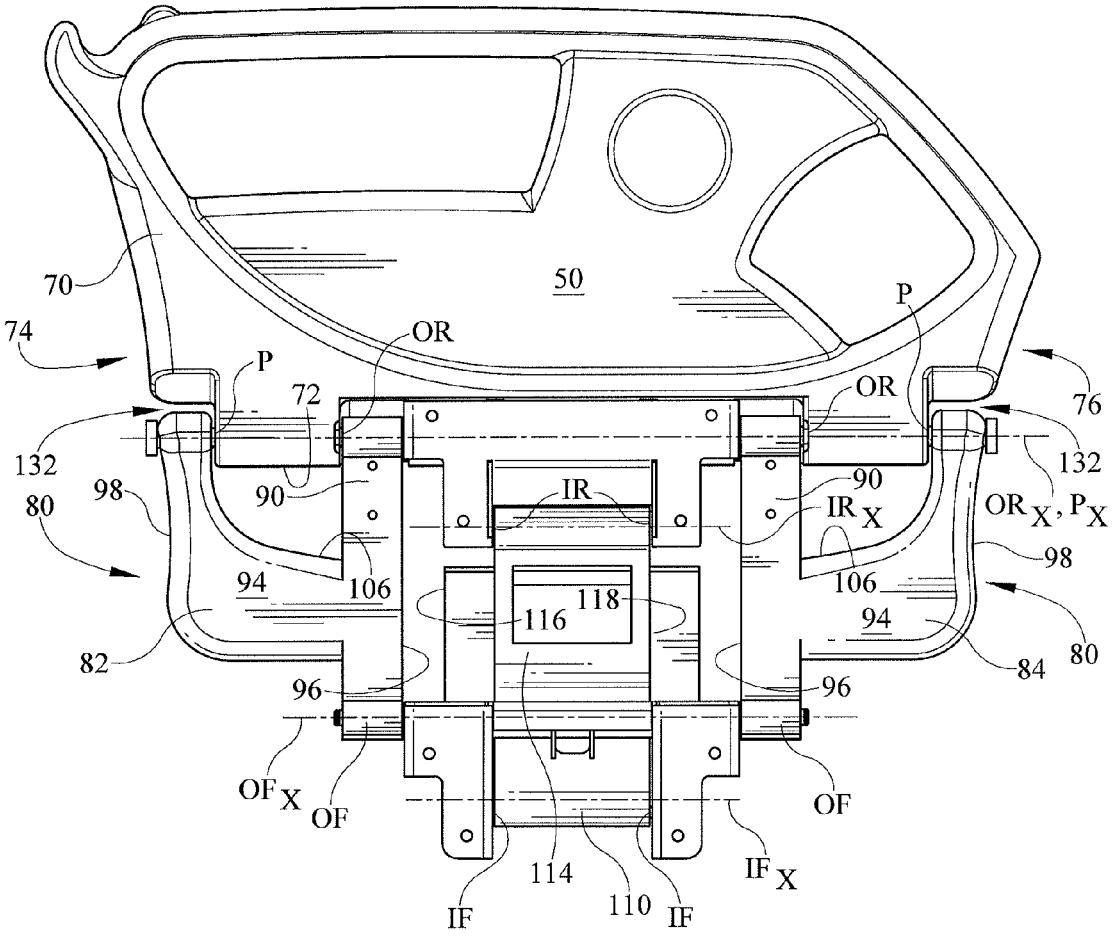
FIG. 5 is a side elevation view of the left side head end siderail as seen from the occupant side of the siderail.
Figure 6:
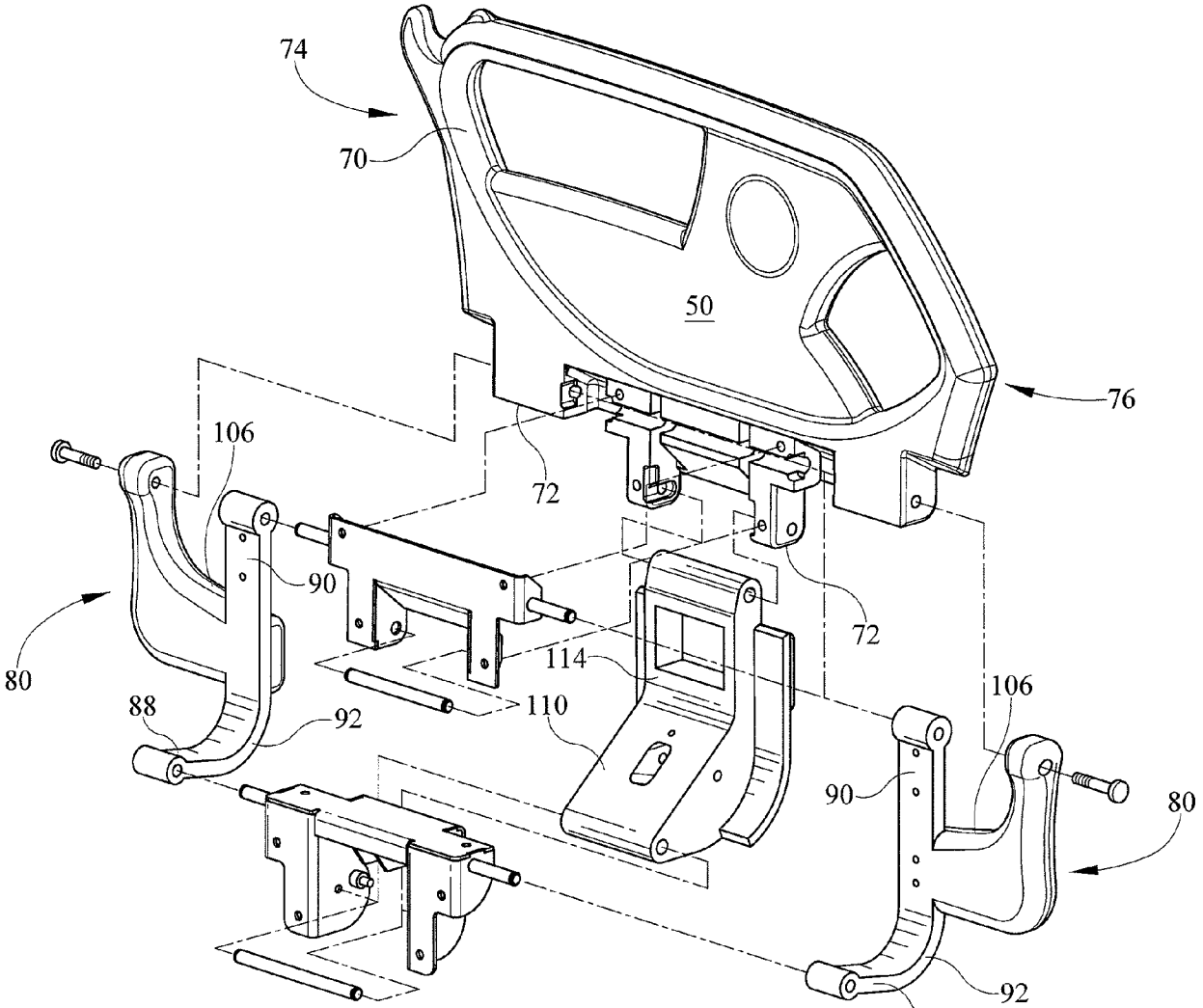
FIG. 6 is an exploded, perspective view of the siderail of FIG. 6 as seen from the occupant side of the siderail.
Figure 10:
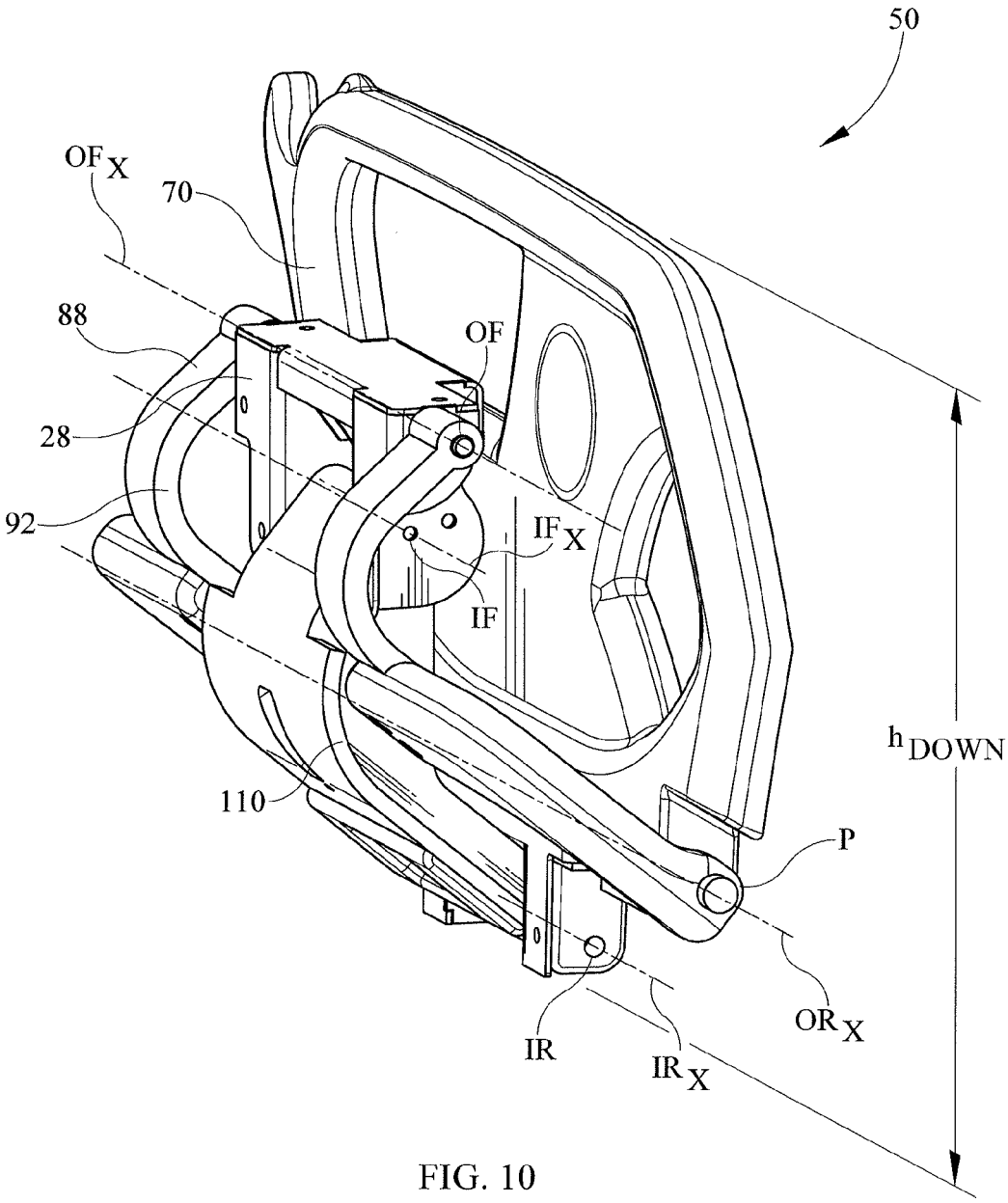

Referring to FIGS. 3-10, right side head end siderail 52 includes a rail 70 having a lower edge 72 extending longitudinally from a rail head end 74 to a rail foot end 76, thereby defining the longitudinal extent L of the lower edge. A longitudinally outer link 80 comprises a head side outer link segment 82 and a foot side outer link segment 84. Each outer link segment is connected to the rail at joints OR and to the host frame 28 at joints OF. An inner link 110 having a laterally outer side 112, a laterally inner side 114, a head side edge 116 and a foot side edge 118 resides longitudinally intermediate the outer link segments 82, 84. The inner link is connected to rail 70 at a joint IR and to host frame 28 at a joint IF. The joints IR, OR, IF, and OF define pivot axes $IR_X$, $OR_X$, $IF_X$, $OF_X$ that extend parallel to centerline 20. Joints IR and OR are laterally displaceable relative to the frame such that rail 70, outer link 80, inner link 110 and frame 28 comprise a four bar linkage enabling movement of the rail between a deployed or raised position (FIGS. 3, 5, 7-9) and a stored or lowered position (FIGS. 4, 10). The progression from the deployed position to the stowed position is seen best in the sequence of views of FIGS. 7-10.

Figure 7:
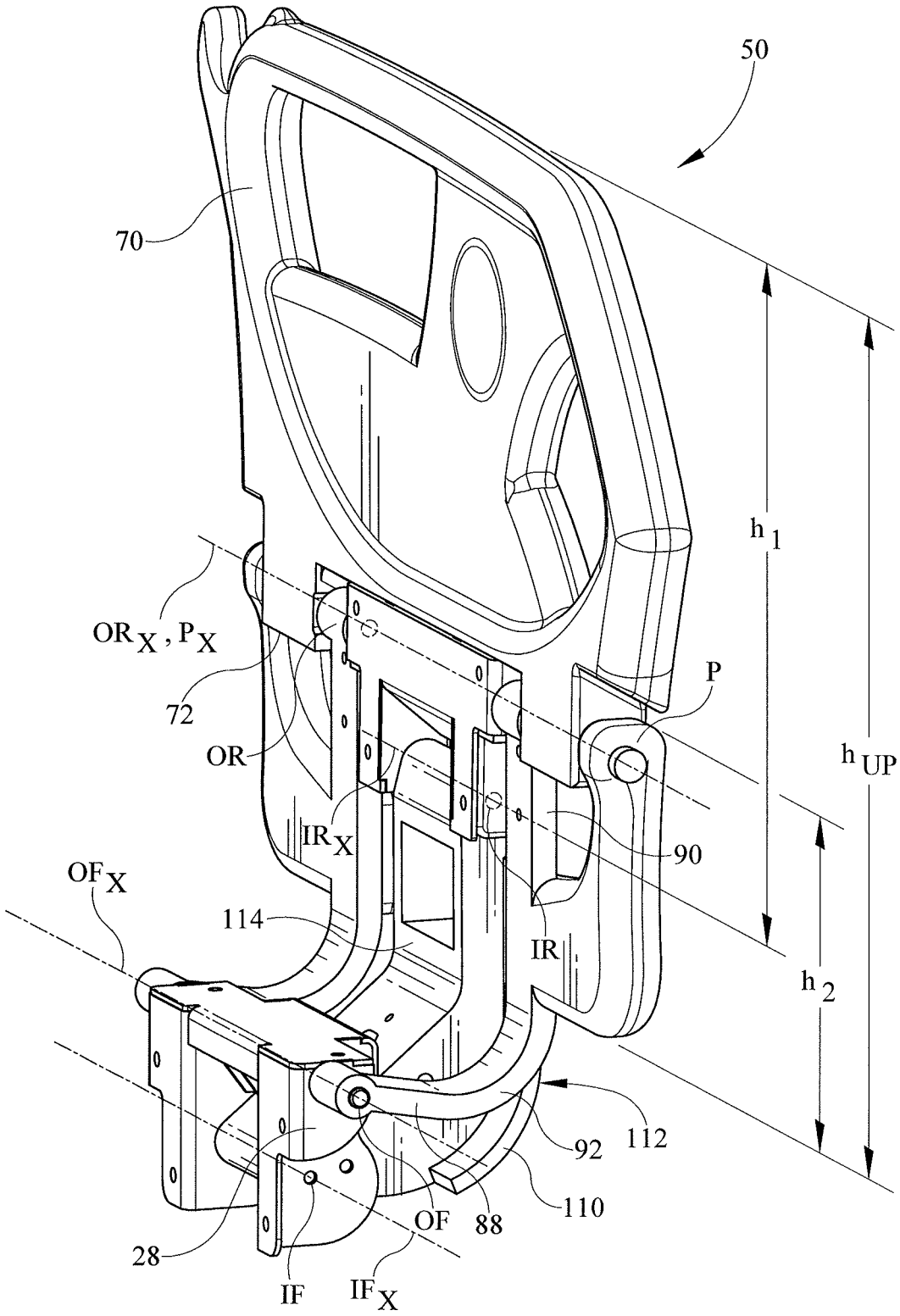
FIGS. 7-10 are a sequence of perspective views of the siderail of FIG. 5 as seen from the occupant side of the siderail showing the siderail in a deployed position, a partially lowered position, a more lowered position, and a stored position respectively.
Figure 8:
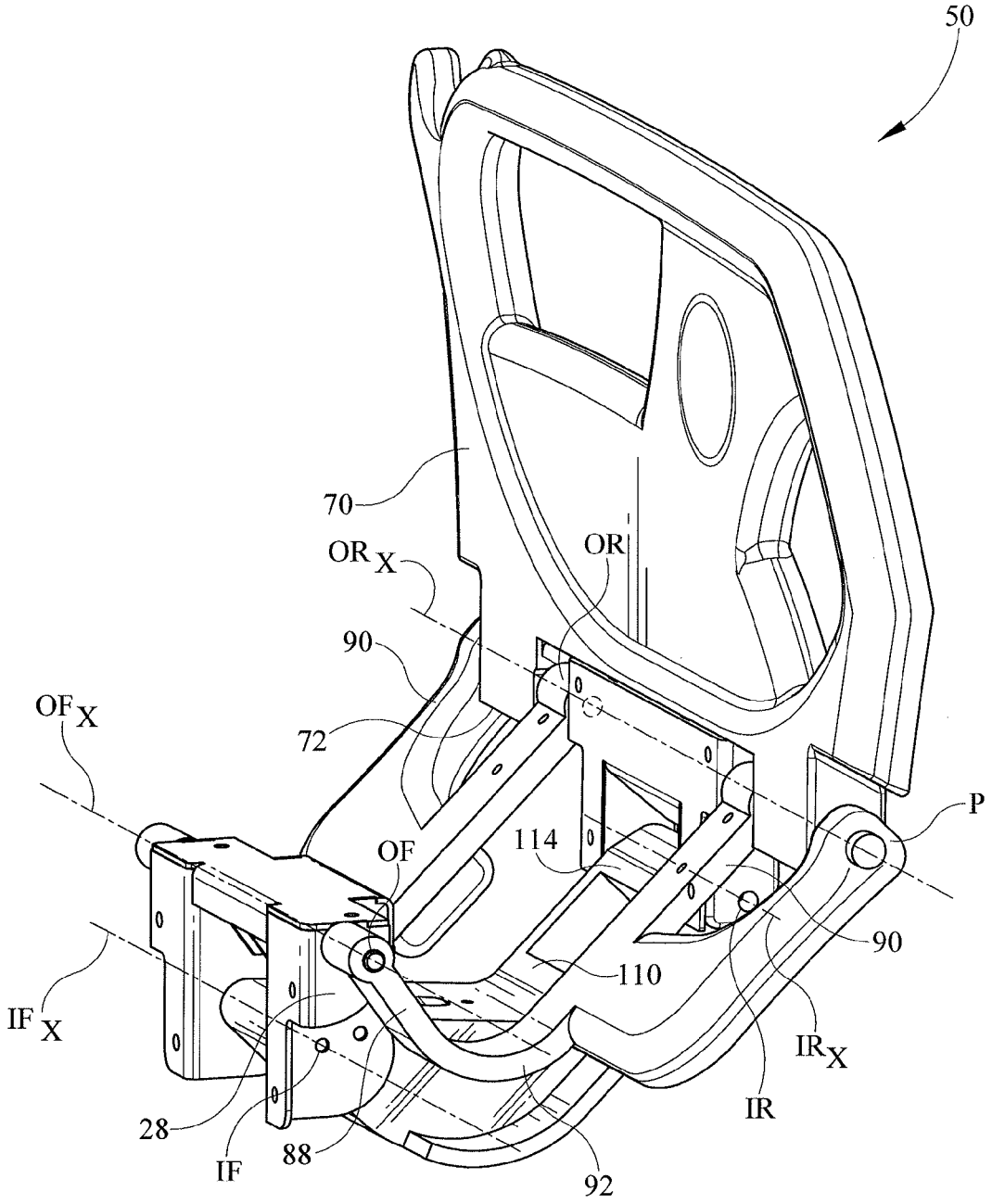
Figure 9:
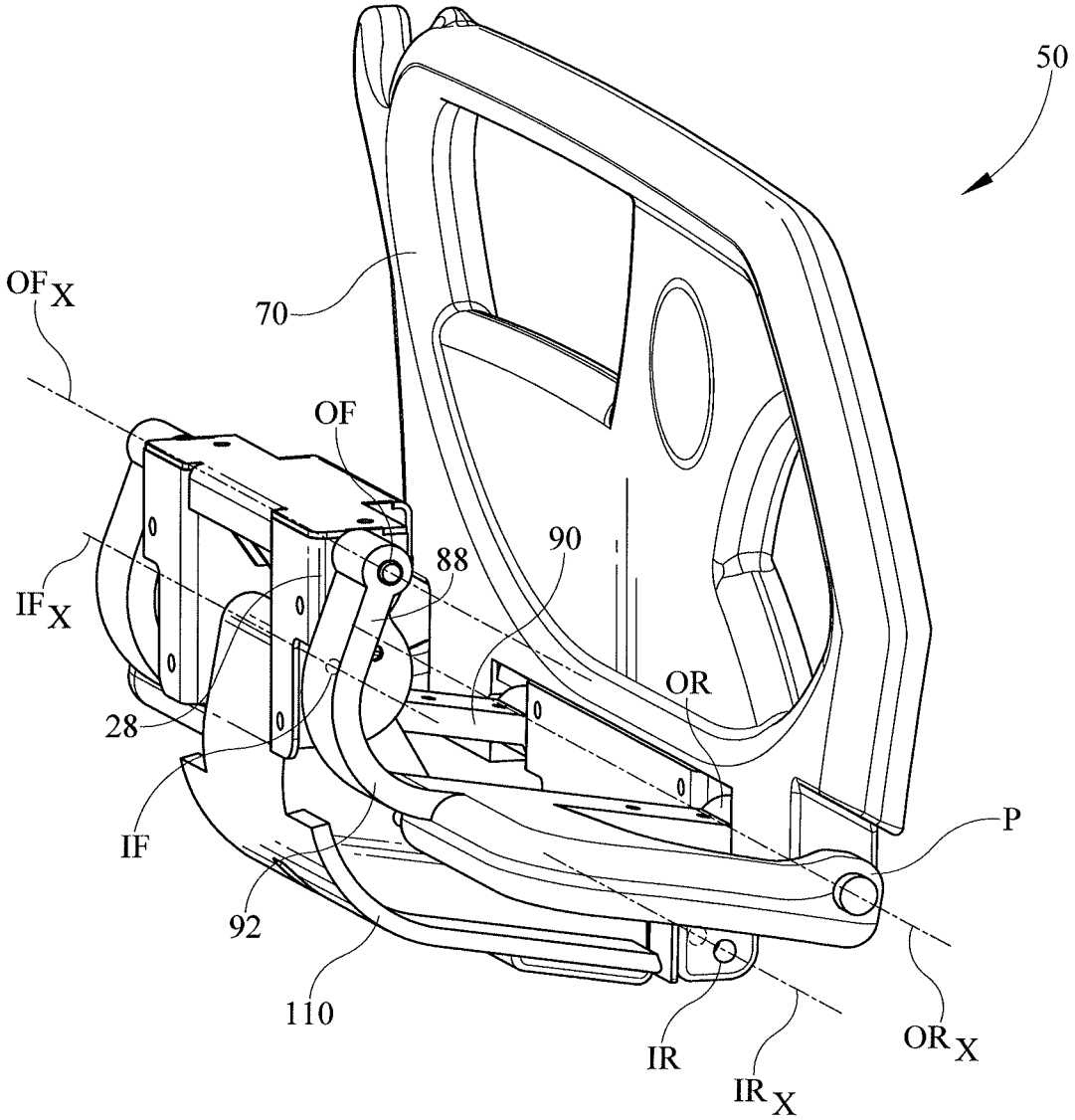

Each outer link segment 82, 84 has a frame end 88, a rail end 90 and an elbow portion 92 extending between the frame and rail ends. The frame end 88 of each segment is connected to frame 28 at joints OF. The frame end 88 of each outer link segment has a longitudinally inboard edge 96 and a longitudinally outboard edge 98, the longitudinally inboard edge 96 being longitudinally closer to inner link 110, and the longitudinally outboard 98 edge being longitudinally further away from the inner link. The rail end 90 of each outer link segment extends from joint OR in a direction nonparallel to that of the frame end 88. For example, when the siderail is in the deployed state as seen in FIG. 7, the frame end 88 of each outer link segment is oriented approximately horizontally while the rail end 90 is oriented substantially vertically. The rail end of each outer link segment includes a wing portion 94 having a top edge 106.

The rail ends 90 of the outer link segments extend longitudinally toward the inner link, but not far enough to overlap the inner link, even partially. In the illustrated siderail, the rail end of the head side outer link segment 82 extends longitudinally from approximately the head end 74 of the rail lower edge, toward the inner link, and terminates at a terminus 100 longitudinally outboard of the inner link. The rail end of the foot side outer link segment 84 extends longitudinally from approximately the foot end 76 of the rail lower edge toward the inner link, and terminates at a terminus 102 also longitudinally outboard of the inner link. In the limit, terminus 100 of the head side outer link segment 82 would be no further inboard than the head side edge 116 of inner link 110, and terminus 102 of the foot side outer link segment 84 would be no further inboard than the foot side edge 118 of inner link 110.

The rail end 90 of each outer link segment 82, 84, in addition to being connected to rail 70 at a joint OR, is also connected to rail 70 at a joint P near the longitudinal ends 74, 76 of the rail. Joint P is a joint between the rail 70 and the wing portion 94 of rail end 90 of each link segment. Joint P defines a pivot axis $P_X$ which is common with pivot axis $OR_X$ of joint OR.

Rail end 90 of each outer link segment has a top edge 106 spaced from rail lower edge 72 along substantially all of the longitudinal extent of the rail end of the outer link thereby defining interedge space 130. The presence of inter-edge space 130 addresses a pinch risk that would be formed by edges 72, 106 if they were separated by a smaller distance. In the illustrated siderail any pinch risk is limited to the regions 132 where the wing portions 94 are in close proximity to the rail in order to be connected thereto at joint P. The space also facilitates cleaning. A larger space 130 will be more advantageous for limiting pinch risk and facilitating cleaning; a smaller space will be less advantageous. The size of space 130 may be determined by the siderail designer or prescribed by regulation or voluntary standards. As is evident from FIGS. 7-10, adequate inter-edge spacing is maintained throughout the range of travel of the rail from deployed to stored.

In the deployed state (e.g. FIG. 7) the rail end of each outer link, including wing portion 94, extends substantially vertically relative to the rail. Consequently the siderail 52 has an effective height $h_{UP}$ defined by a height $h_1$ of the rail and a height $h_2$ of the rail end of the outer link segments. As the siderail is lowered (FIGS. 8, 9) to a fully stored state (FIG. 10 or FIG. 4) the rail end of each outer link panel, including wing portion 94, folds up laterally inwardly of the rail (i.e. behind the rail). Consequently, the siderail, when in the stored state, has an effective height $h_{DOWN}$ which is less than $h_{UP}$. In the illustrated embodiment, no part of the outer link segments 82, 84 projects vertically below lower edge 72 of the rail when the siderail is in the stored state. Accordingly, the outer link segments make no contribution to the height $h_{DOWN}$. The larger effective height $h_{UP}$ when the siderail is deployed, combined with the smaller effective height $h_{DOWN}$ when the siderail is stored, enables the siderail to meet the potentially conflicting design requirements of the deployed and stored states. In addition, the smaller effective height $h_{DOWN}$ provides additional latitude for a bed occupant to position his heels under his center of gravity, which is desirable when a bed occupant is moving out of or into the bed by way of a sitting position with his or her legs draped over the side of the bed. The smaller effective height also offers an improved line of sight and access to foot pedal controls, such as foot pedals 42 (FIG. 1).

Figure 11:
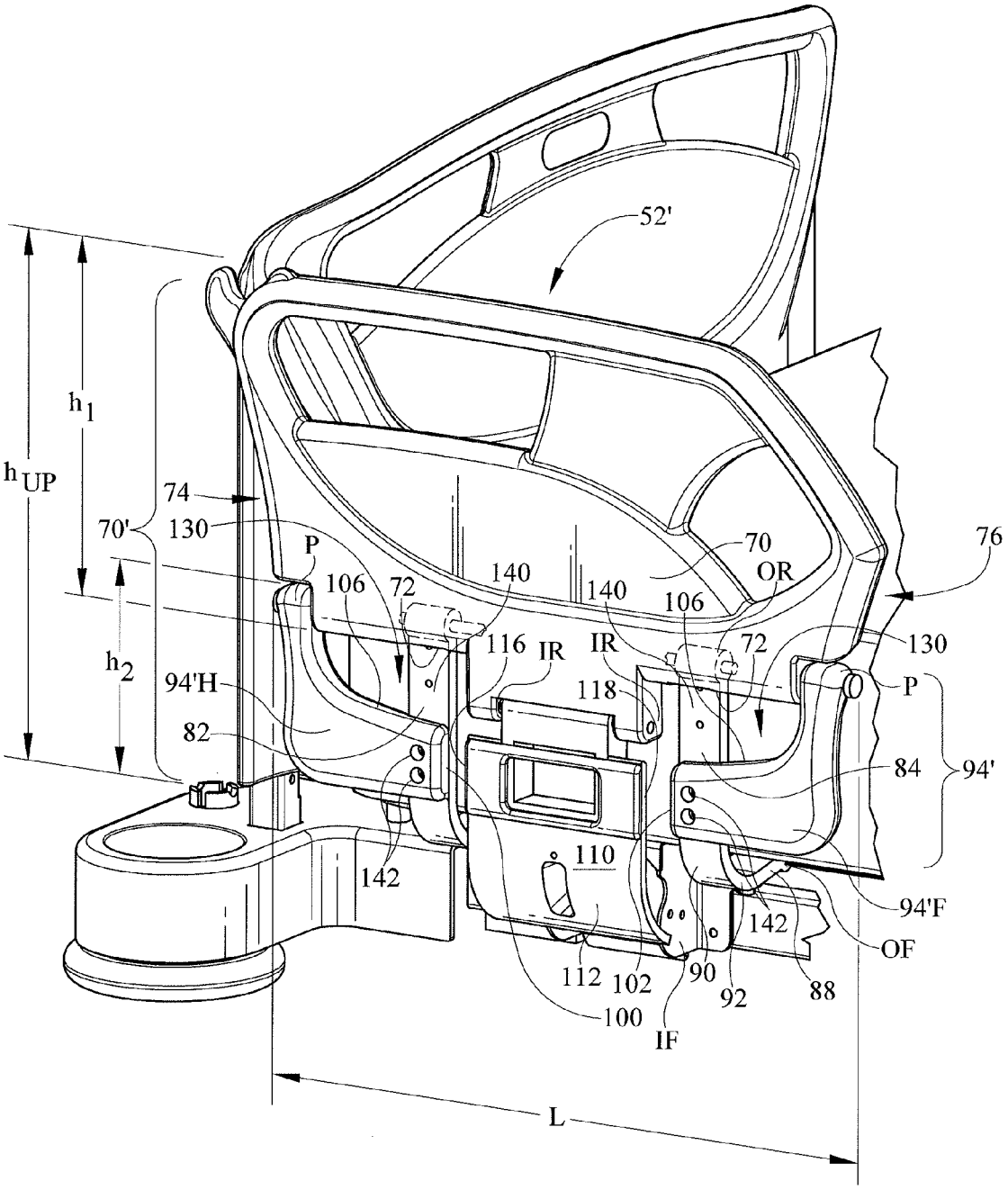
FIG. 11 is a view similar to that of FIG. 3 showing a variable height siderail in which an outer link portion thereof is constructed of two pieces, the siderail being shown in a deployed position.

In the embodiment of FIGS. 1-10 each outer link segment is illustrated as a one piece structure. However it is expected that in practice each outer link segment would be a two piece structure. Referring to FIG. 11 the two piece structure comprises an arm 140 extending between joints OF and OR and a separately manufactured panel 94', analogous to wing portion 94 of the single piece construction, affixed to arm 140 by fasteners 142. Such a construction allows the designer to specify the use of different materials best suited for the demands placed on the arm and panel portions of the outer link segments.

The above mentioned two piece construction leads to an alternative interpretation in which a siderail 52' comprises a rail 70' having an upper panel 70 and a lower panel 94'. The upper panel lower edge 72 extends longitudinally from upper panel head end 74 to upper panel foot end 76. The siderail also includes longitudinally outer link 80 comprising head side outer link segment 82 and foot side outer link segment 84. Each outer link segment comprises the arm 140 comprising frame end, rail end and elbow portions 88, 90, 92 respectively, and the separately manufactured panel 94' affixed to its rail end by fasteners 142. The siderail also includes inner link 110 longitudinally intermediate the outer link segments. The inner link is connected to the upper panel 70 at joint IR and to the host frame 78 at joint IF.

The rail lower panel 94 comprises head side and foot side subpanels 94'H, 94'F, each of which is connected to one of the outer link segments by the fasteners 142 so that the subpanels, and therefore the lower panel 94' as a whole, are stationary with respect to the outer link 80. The lower panel extends longitudinally from substantially the head end 74 to the foot end 76 of the upper panel lower edge 72 without longitudinally overlapping or crossing over the laterally outer side 112 of the inner link. The illustrated lower panel avoids crossing over the inner link by virtue of the twin panel construction in which subpanel 94'H extends longitudinally footwardly toward the inner link but has a terminus 100 longitudinally outboard of head side edge 116 of the inner link, and subpanel 94'F extends longitudinally headwardly toward the inner link but has a terminus 102 longitudinally outboard of inner link foot side edge 118.

As shown in FIG. 11, each subpanel 94'H, 94'F, in addition to being connected to one of the arms 140, may also be pivotably connected to upper panel 70 at joint P.

Top edge 106 of each subpanel is spaced from upper panel lower edge 72 along substantially all of the longitudinal extent of the lower panel thereby defining the interedge space 130.

Figure 12:
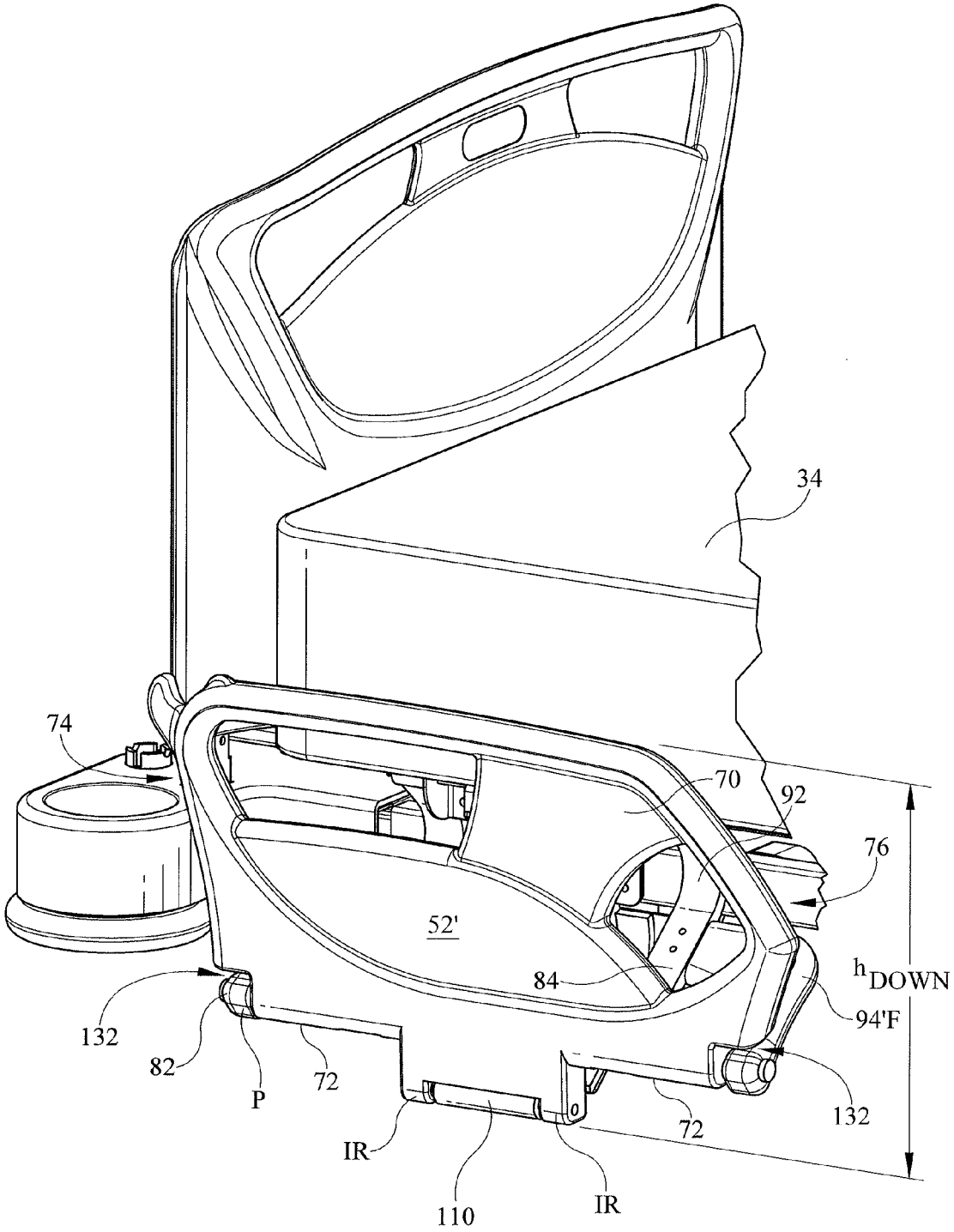
FIG. 12 is a view similar of the siderail of FIG. 11 showing the siderail in a stored position.

In the deployed state (FIG. 11) the subpanels 94'H, 94'F, extend substantially vertically relative to the upper panel 70. Consequently the siderail 52' has an effective height $h_{UP}$ defined by a height $h_1$ of the upper panel and a height $h_2$ of the lower panel. As the siderail is lowered to a fully stored state (FIG. 12) the subpanels fold up laterally inwardly of the upper panel (i.e. behind the upper panel). Consequently, the siderail, when in the stored state, has an effective height $h_{DOWN}$ which is less than $h_{UP}$. In the illustrated embodiment, no part of the lower panel projects vertically below lower edge 72 of the upper panel when the siderail is in the stored state. Accordingly, the lower panel makes no contribution to the height $h_{DOWN}$. The larger effective height $h_{UP}$ when the siderail is deployed, combined with the smaller effective height $h_{DOWN}$ when the siderail is stored, enables the siderail to meet the potentially conflicting design requirements of the deployed and stored states.

Figure 13:
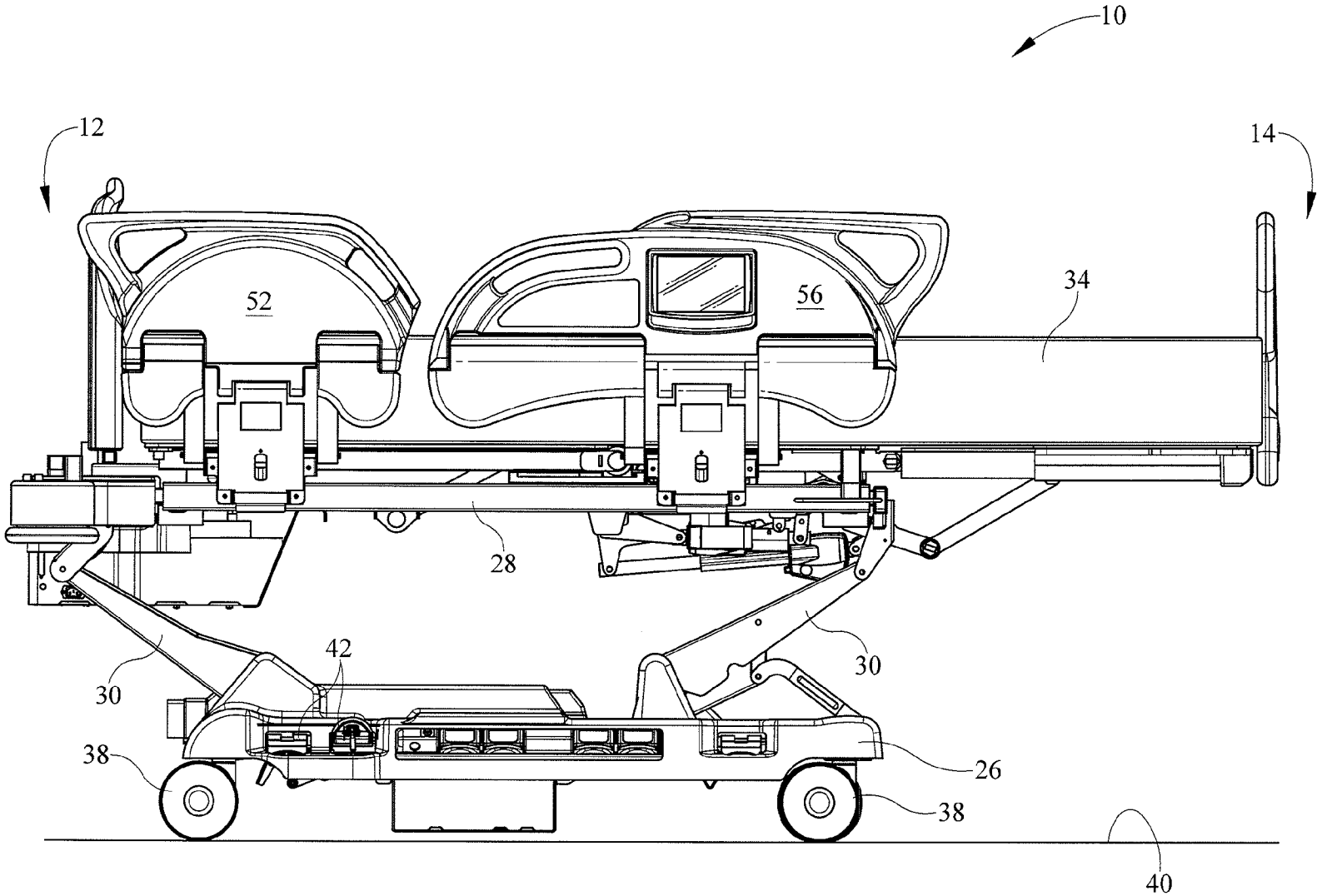
FIG. 13 is a view similar to that of FIG. 1 showing other embodiments of the variable height siderail.
Figure 14:
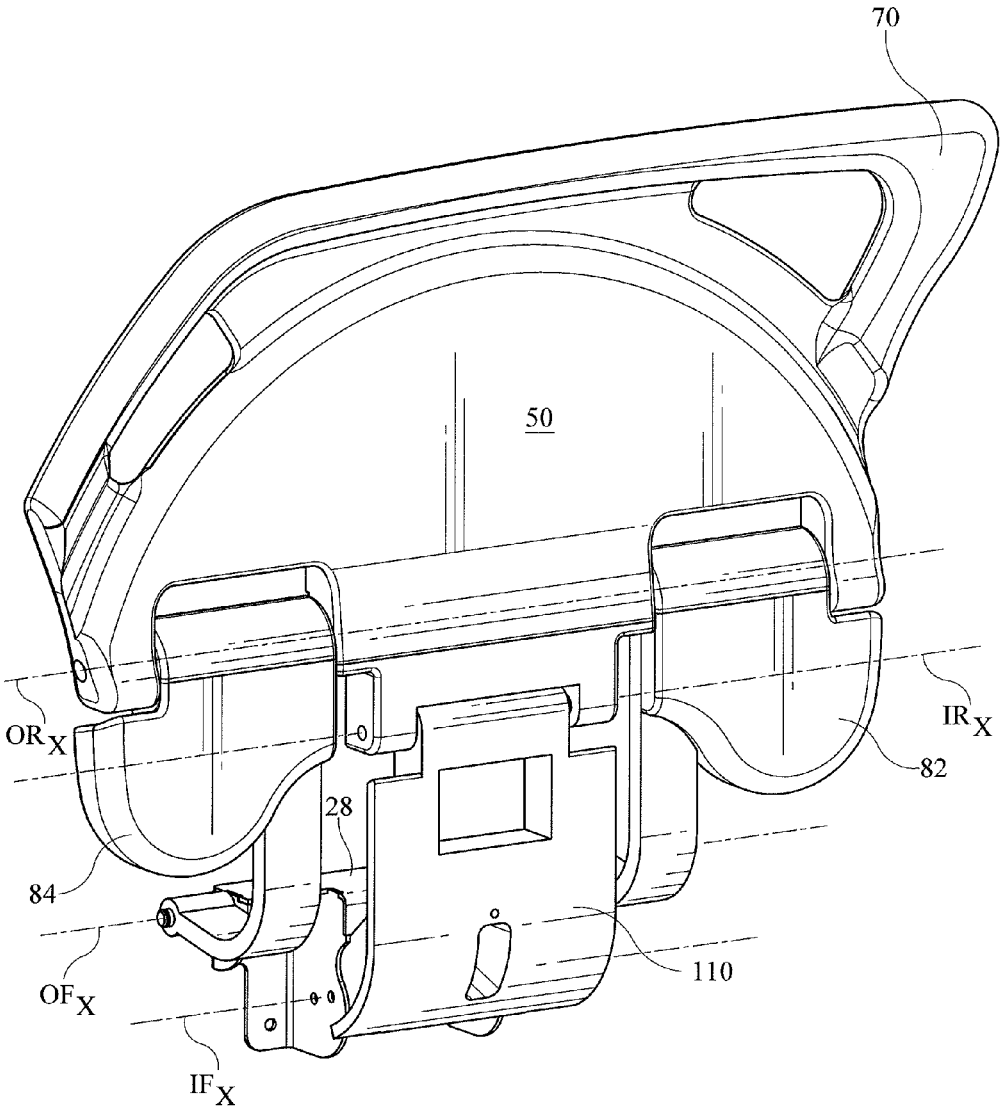
FIG. 14 is a perspective view of the head end siderail of FIG. 13.

FIGS. 13-14 show a bed with siderails whose physical configuration differs from that of the siderails shown in FIGS. 1-12. In both cases the space 130 between the wing portion of the outer link segments and the rail (or between the upper and lower panels in the alternate interpretation) is smaller than the space 130 of FIGS. 1-12. However the differences in appearance do not affect the variable height attribute already described herein.

In the foregoing description, terms such as "inner" and "outer" (describing laterally opposite sides of the inner link) and "top" (describing an edge of the rail end of the outer link segments or subpanels) were chosen based on the deployed orientation of the siderail components as seen, for example, in FIGS. 3 and 7. These terms are intended to apply to those same sides and edge even when the siderail is in the stowed position.

Although this disclosure refers to specific embodiments, it will be understood by those skilled in the art that various changes in form and detail may be made without departing from the subject matter set forth in the accompanying claims.

The invention claimed is:

1. A siderail for a patient bed, the siderail comprising:

a rail main body having a lower edge extending in a longitudinal direction from a head end to a foot end of the siderail, a first outer link segment hinged to the rail main body adjacent the head end, and a second outer link segment hinged to the rail main body adjacent the foot end, wherein the first outer link segment and the second outer link segment have a thickness that is substantially the same as a thickness of the rail main body, the first and second outer links folding in unison relative to the rail main body from a first position situated substantially vertically beneath the rail main body to a second position generally overlapping the rail main body as the rail main body is moved relative to the patient bed from a raised position to a lowered position, wherein the first outer link segment has a curved head end link edge that follows a substantially contiguous, substantially vertical contour with a curved head end body edge of the rail main body such that the curved head end link edge cooperates with the curved head end body edge to form an overall contiguous curved profile at the head end of the siderail when the first and second outer links are in the first position and when viewed laterally of the patient bed in a substantially horizontal direction that is substantially perpendicular to the longitudinal direction, wherein the second outer link segment has a curved foot end link edge that follows a substantially contiguous, substantially vertical contour with a curved foot end body edge of the rail main body such that the curved head end link edge cooperates with the curved head end body edge to form an overall contiguous curved profile at the foot end of the siderail when the first and second outer links are in the first position and when viewed laterally of the patient bed in the substantially horizontal direction that is substantially perpendicular to the longitudinal direction.

2. The siderail of claim 1, wherein the first outer link segment comprises a generally L-shaped structure including a first portion extending generally parallel with the lower edge of the rail main body and a second portion extending generally perpendicular to the lower edge of the rail main body.

3. The siderail of claim 2, wherein the rail main body has a notch adjacent the head end and an end of the second portion of the first outer link segment is received in the notch.

4. The siderail of claim 3, wherein the end of the second portion of the first outer link segment is hinged to the rail main body within the notch.

5. The siderail of claim 2, wherein the first portion of the first outer link segment is spaced from the lower edge of the rail main body by a sufficient distance to prevent pinching of a user's fingers during raising and lowering of the rail main body.

6. The siderail of claim 1, wherein the second outer link segment comprises a generally L-shaped structure including a first portion extending generally parallel with the lower edge of the rail main body and a second portion extending generally perpendicular to the lower edge of the rail main body.

7. The siderail of claim 6, wherein the rail main body has a notch adjacent the foot end and an end of the second portion of the second outer link segment is received in the notch.

8. The siderail of claim 7, wherein the end of the second portion of the second outer link segment is hinged to the rail main body within the notch.

9. The siderail of claim 6, wherein the first portion of the second outer link segment is spaced from the lower edge of the rail main body by a sufficient distance to prevent pinching of a user's fingers during raising and lowering of the rail main body.

10. The siderail of claim 1, wherein the first outer link segment and the second outer link segment are shaped as mirror images of each other.

11. The siderail of claim 1, wherein the first outer link segment is separated from the second outer link segment to define a gap therebetween.

12. The siderail of claim 11, further comprising an inner link hinged to the rail main body and including a portion situated in the gap.

13. The siderail of claim 12, wherein the first and second outer link segments fold relative to the rail main body about a first axis, the inner link folds relative to the rail main body about a second axis, and the second axis is spaced from and substantially parallel with the first axis.

14. The siderail of claim 13, wherein the second axis is lower in elevation than the first axis.

15. The siderail of claim 1, wherein the first and second outer link segments each comprise an arm and a separately manufactured panel.

16. The siderail of claim 1, wherein the first and second outer link segments are connected to the rail main body near respective longitudinal ends of the rail main body.

* * * * *